US006179035B1

(12) United States Patent
Anderson

(10) Patent No.: US 6,179,035 B1
(45) Date of Patent: Jan. 30, 2001

(54) VENETIAN BLIND

(75) Inventor: Richard N. Anderson, Whitesville, KY (US)

(73) Assignee: Hunter Douglas Inc., Upper Saddle River, NJ (US)

( * ) Notice: Under 35 U.S.C. 154(b), the term of this patent shall be extended for 53 days.

(21) Appl. No.: 08/797,521

(22) Filed: Feb. 7, 1997

Related U.S. Application Data

(60) Provisional application No. 60/011,329, filed on Feb. 8, 1996.

(51) Int. Cl.[7] ..... E06B 9/30
(52) U.S. Cl. ..... 160/168.1 R
(58) Field of Search ..... 160/168.1 R, 173 R, 160/176.1 R, 178.3 R

(56) References Cited

U.S. PATENT DOCUMENTS

| | | | | |
|---|---|---|---|---|
| 2,122,224 | * | 6/1938 | Wade et al. | 160/168.31 R |
| 2,200,349 | | 5/1940 | Walker . | |
| 2,275,273 | * | 3/1942 | Taylor | 160/178.3 R X |
| 2,307,278 | * | 1/1943 | Krantz | 160/176.1 R X |
| 2,397,765 | * | 4/1946 | Sylvanus | 160/168.1 R X |
| 2,440,769 | | 5/1948 | Hackett . | |
| 2,572,224 | * | 10/1951 | Walker | 160/173 R |
| 2,576,159 | | 11/1951 | Walker . | |
| 2,578,749 | * | 12/1951 | Schultz | 160/168.1 R |
| 2,578,766 | | 12/1951 | Walker . | |
| 2,583,031 | | 1/1952 | Walker . | |
| 2,614,623 | | 10/1952 | Nelson . | |
| 2,620,865 | | 12/1952 | Isserstedt . | |
| 2,652,111 | | 9/1953 | Walker . | |
| 2,669,301 | | 2/1954 | Evans . | |
| 2,728,108 | * | 12/1955 | Schlegel | 160/178.3 R X |
| 2,762,865 | | 9/1956 | Abbott, Jr. . | |
| 3,256,928 | * | 6/1966 | Hensel | 160/178.3 R |
| 4,945,971 | | 8/1990 | Ivarsson et al. . | |
| 4,951,729 | | 8/1990 | Yu . | |
| 5,060,709 | * | 10/1991 | Simon | 160/176.1 R X |
| 5,573,051 | | 11/1996 | Judkins . | |
| 5,582,226 | * | 12/1996 | Voss et al. | 160/178.3 R X |

FOREIGN PATENT DOCUMENTS

| | | |
|---|---|---|
| 857267 | 12/1960 | (GB) . |
| 1000626 | 8/1965 | (GB) . |
| 266845 | 6/1968 | (NL) . |
| 276925 | 8/1968 | (NL) . |

* cited by examiner

*Primary Examiner*—David M. Purol
(74) *Attorney, Agent, or Firm*—Dorsey & Whitney LLP

(57) ABSTRACT

A Venetian blind is formed by a plurality of parallel elongate slats disposed in parallel spaced relation between a headrail and a bottom rail. Ladder cords secured between the headrail and bottom rail include riser cords and spaced apart cross rung cords for supporting the slats in transversely spaced apart relation. Lift cords depend from the headrail and are secured to the bottom rail for lifting the bottom rail and slats into closely spaced stacked relation and for lowering the slats into wider spaced relation. Each lift cord is interwoven with one of the ladders adjacent a longitudinal edge of the slats, and may be intertwined with a riser cord thereof. Notches are provided in one edge of the slats.

17 Claims, 9 Drawing Sheets

24
36
26
27
36
26
36
27

24
36
27
26
27
26
36
36
26
27

24
36
26

24
26
36
26

24
26
36
26

VENETIAN BLIND

This application claim benefit to Provisional application Ser. No. 60/011,329 filed Feb. 8, 1996.

BACKGROUND OF THE INVENTION

1. Field of the Invention

The present invention relates to Venetian blinds and more particularly to ladder and lift cord arrangements for Venetian blinds.

2. Description of the Prior Art

Venetian blinds conventionally embody a headrail, a bottom rail, and a plurality of transverse, spaced apart, parallel slats extending parallel to the headrail and bottom rail and supported on the transverse cords or cross rungs of a latter or string tape secured to the headrail and bottom rail. The cross rungs extend between and are secured to the riser cords of the ladder. Lift cords conventionally extend through slots in each of the slats and are secured to the bottom rail for raising and lowering the bottom rail and thereby the slats to raise or expand the blind respectively. As alternatives, U.S. Pat. No. 2,669,301 discloses a Venetian blind in which the lift cord extends through relief notches along one edge of the blind slats between the slats and an adjoining ladder tape. U.K. Pat. No. 1,000,626 discloses a Venetian blind in which the lift or pull cord extends through loops in one riser cord of the ladder. U.S. Pat. No. 5,060,709 discloses a blind having lift cords displaced on the front and back of the slats, the front lift cords being intertwined through the ladder tape, while the back lift cords pass through and are trapped in place by loops extending from the ladder tape. The '709 patent also discloses notches on both the front and back of the slats to prevent the slats from sliding to either side.

OBJECTS OF THE INVENTION

It is the principal object of the present invention to provide an improved Venetian blind.

Another object of the present invention is to provide an improved Venetian blind with an improved lift cord and ladder cord arrangement.

SUMMARY OF THE INVENTION

In accordance with the foregoing objects, the present invention is embodied in a Venetian blind having a plurality of parallel elongate slats spaced apart between a headrail and a bottom rail. Ladders formed by a pair of spaced riser cords and spaced apart cross rungs extending between said riser cords support the slats in transversely spaced apart relation. Lift cords raise the bottom rail and slats into closely spaced stacked relation and lower the slats into wider spaced parallel relation. Each lift cord is interlaced or interwoven with the associated one of the ladders adjacent a longitudinal edge of the slats.

DESCRIPTION OF THE PREFERRED EMBODIMENT

Figure 1:
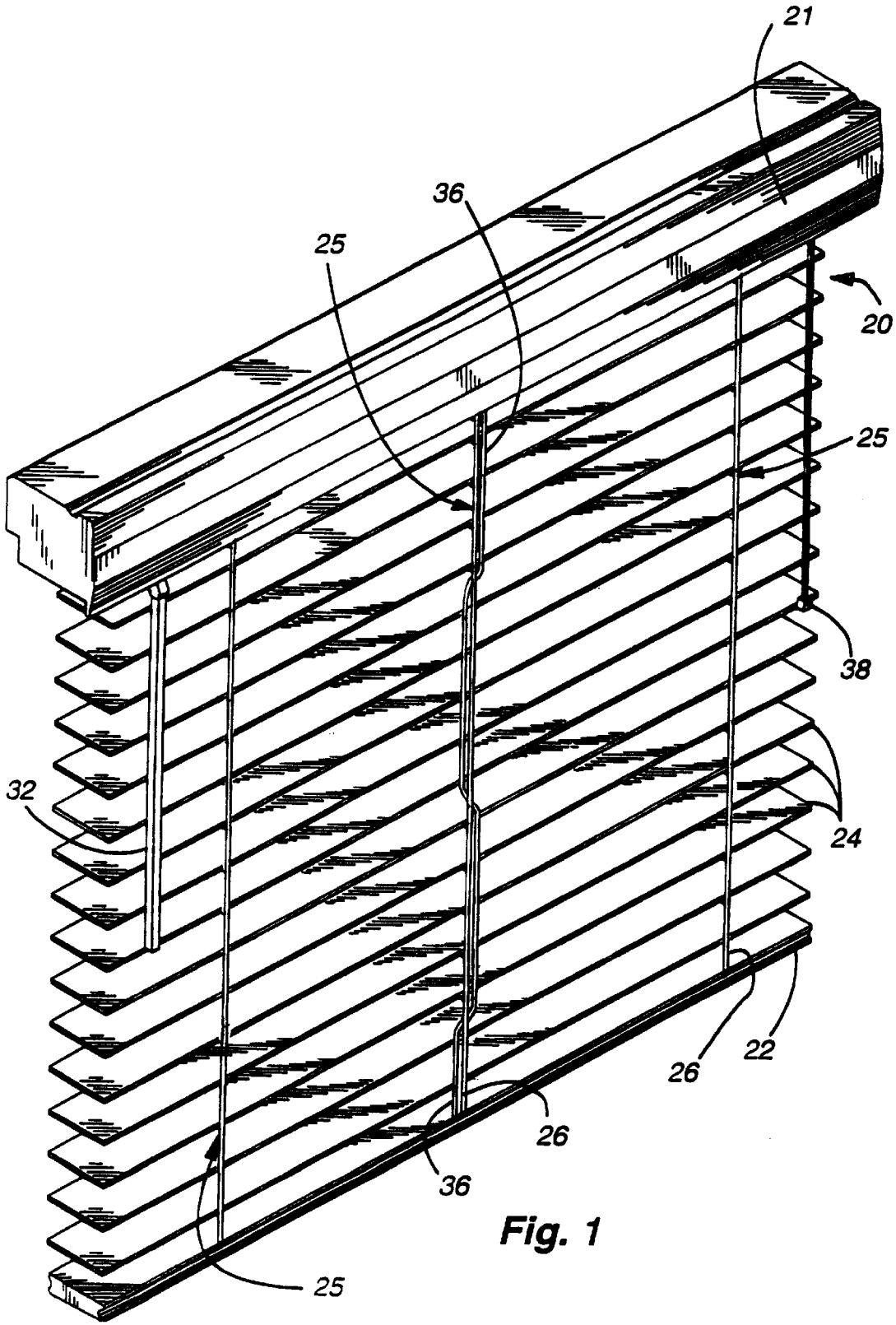
FIG. 1 is an isometric view from the left end of a Venetian blind embodying the present invention.

The present invention is, as shown in the drawings, embodied in a Venetian blind 20 having an elongated headrail 21, an elongated bottom rail 22, and a plurality of intermediate, spaced apart, elongated, parallel slats 24 supported between the headrail 21 and bottom rail 22 by two or more string tapes or ladders 25 secured between the headrail 21 and bottom rail 22. The slats may be formed of any selected material such as metal, wood or plastic. The ladders are formed by front riser cords 26, rear riser cords 27, and a plurality of transverse cords or cross rungs 28 preferably multistrand formed by separate strands or cords 29, 30. At their bottom ends, the ladder riser cords 26, 27 are secured to the bottom rail 22. At their upper ends, the ladder riser cords 26, 27 are secured to a tilt mechanism (not shown) forming a part of the headrail.

Figure 6:
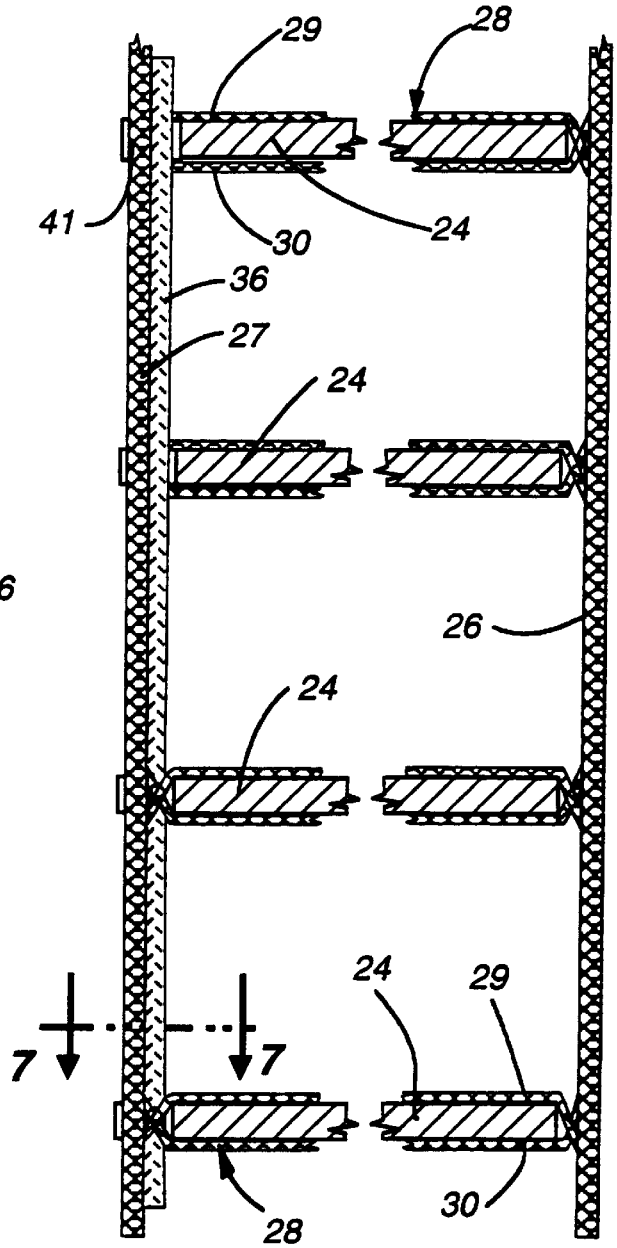
FIG. 6 is a further enlarged view similar to FIG. 5.
Figure 9:
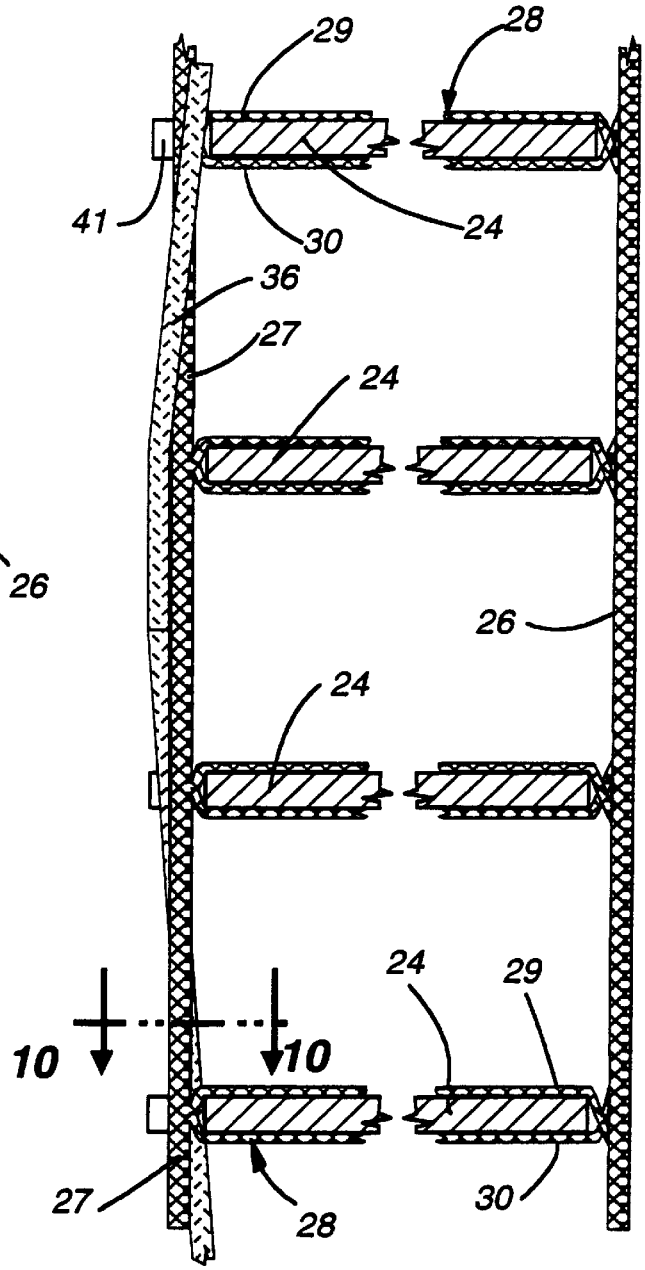
FIG. 9 is a further enlarged view similar to FIG. 8.

In a preferred general construction (FIGS. 1–4), the slats 24 are supported on corresponding cross rungs 28 in spaced apart relation. For some applications (FIGS. 11, 12 for example), with slats having a relatively large width, the slats may be inserted or interlaced between one or more of the separate strands 29, 30 of each cross rung 28. In one interlace arrangement, the slats are inserted between the parallel cross rungs with the upper stand 29 on top of the slat and the lower strand 30 beneath and supporting the slat. Alternatively, as shown in FIGS. 6 and 9, interlacing may be achieved by crossing the cross rung strands 29, 30 before interlacing so that the upper strand 29 is on the bottom of the slat and the lower strand 30 is on the top after interlacing with a slat. More particularly, in Venetian blinds with wooden slats 24, the slats are preferably interlaced only at one end of the Venetian blind, which could be either end of the blind (FIG. 11), which end may be referred to as the control end. In Venetian blinds with metal slats, the slats 24 are preferably inserted or interlaced with all the cross rungs 28 of the ladders to provide stability and resistance to lengthwise slipping (FIG. 12). Also, to prevent slipping, conventional retaining cords (not shown) may be arranged through small aligned holes (not shown) in the slats.

Figure 2:
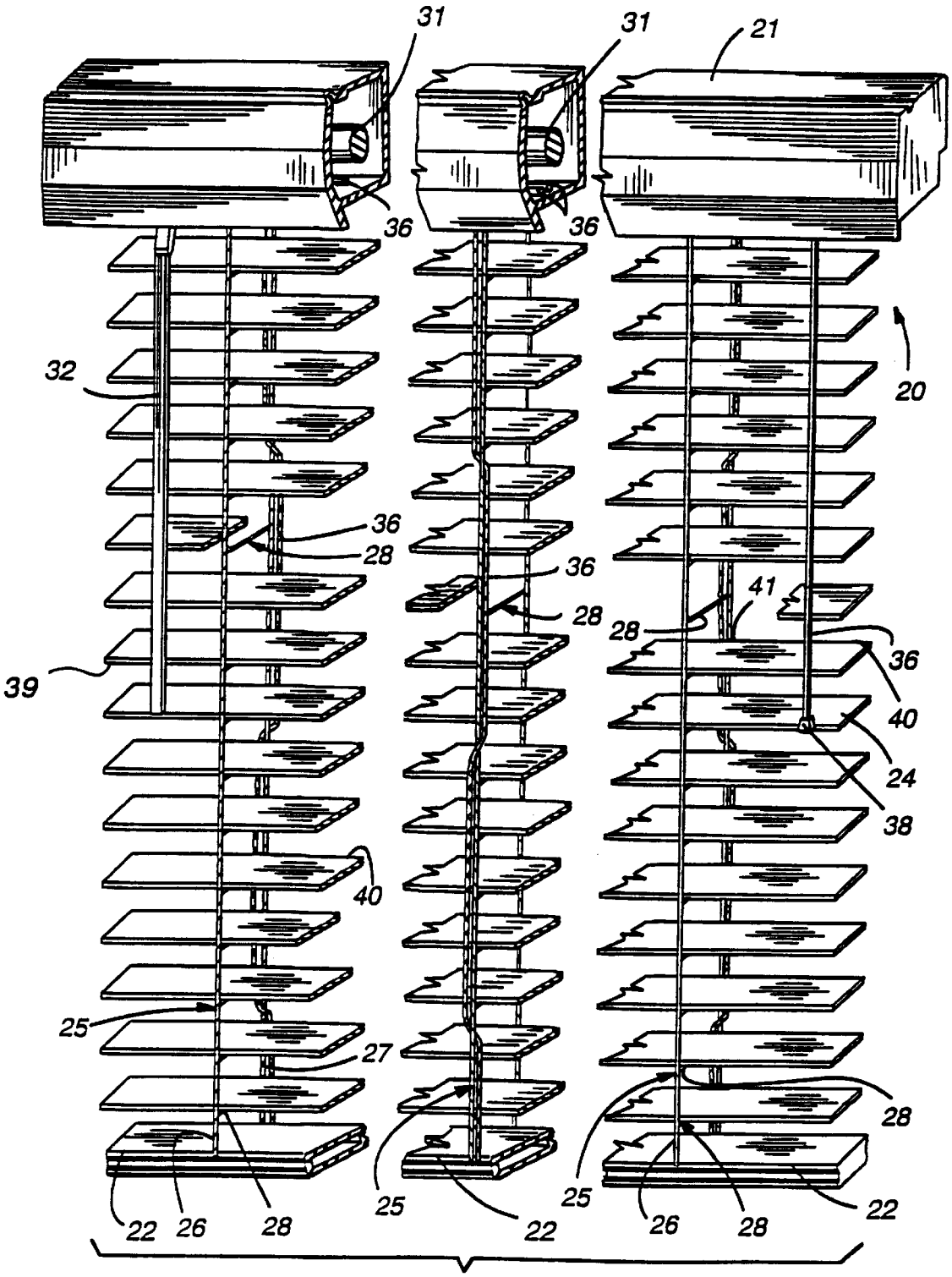
FIG. 2 is an enlarged oblique cabinet view of the Venetian blind shown in FIG. 1 with parts cut away for clarity in illustration.
Figure 3:
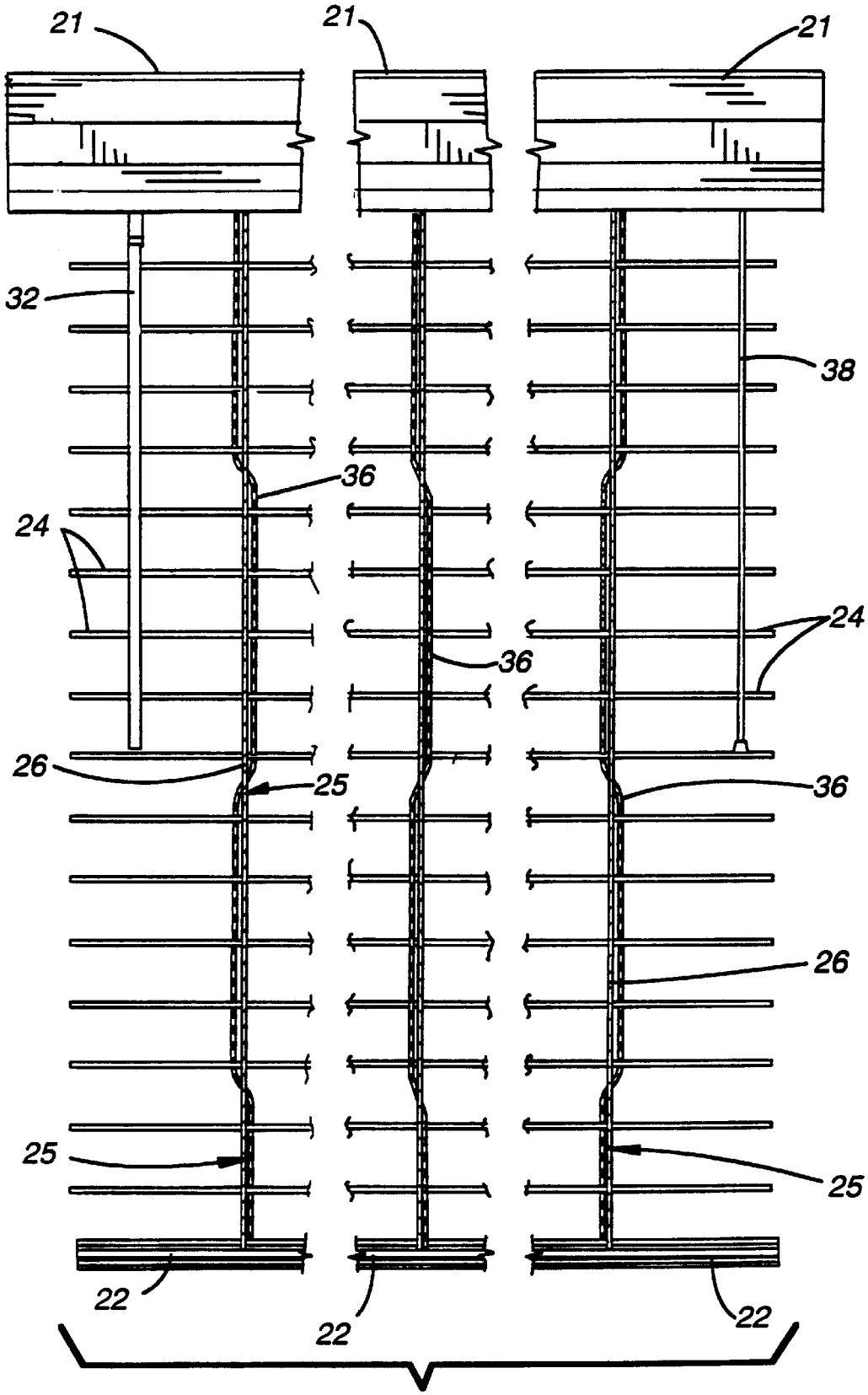
FIG. 3 is a front elevation view of the Venetian blind shown in FIGS. 1 and 2, with portions cut away.
Figure 4:
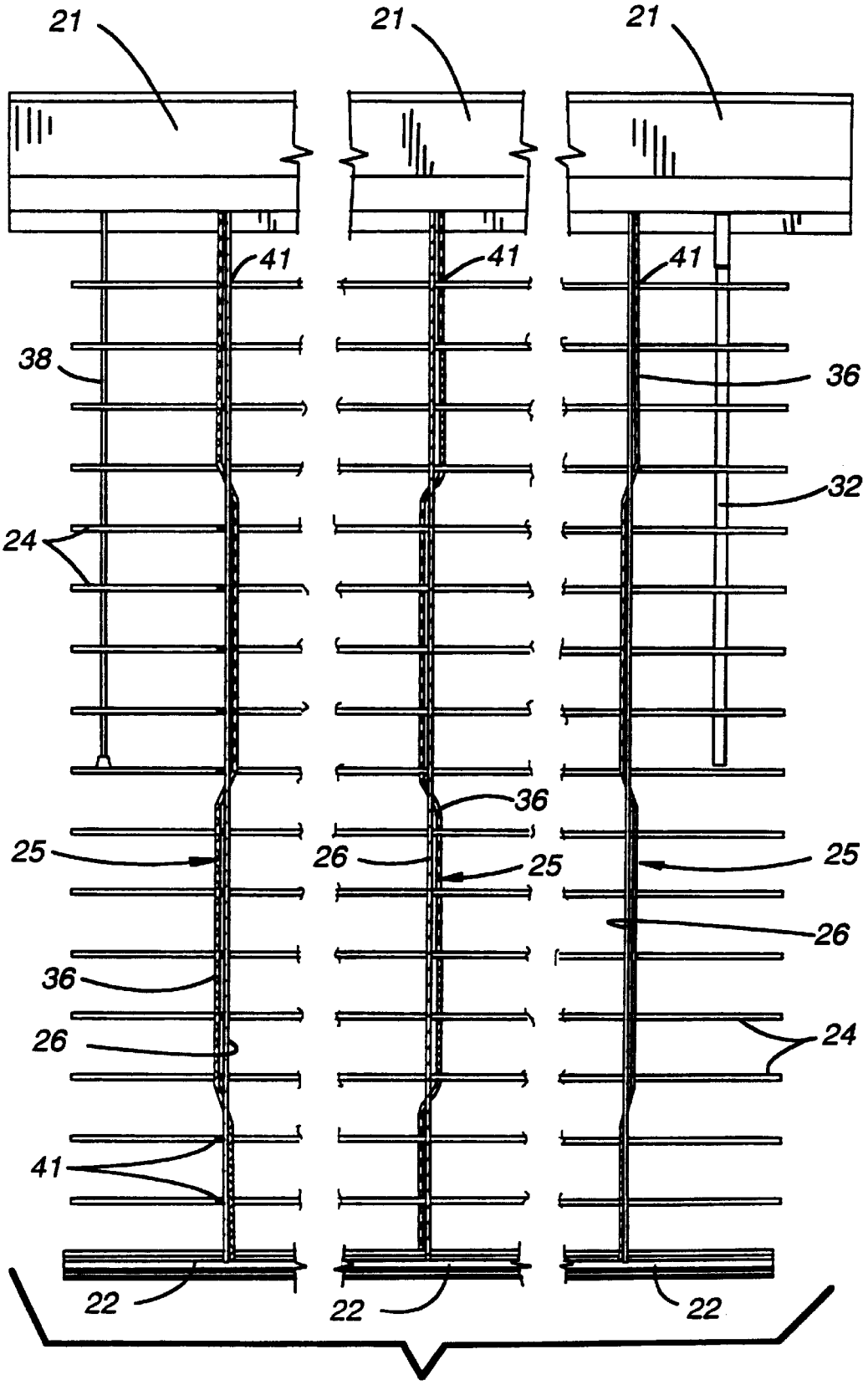
FIG. 4 is a rear elevation view of the Venetian blind shown in FIG. 2, with portions cut away.

For tilting the slats, the ladders are secured to an appropriate conventional tilting mechanism housed within the headrail and including a rotatable rod 31 operated by a wand 32 (FIG. 2). Turning the tilt rod 31 moves the riser cords 26, 27 relative to each other to tilt the cross rungs 28 and the slats 24 supported thereby to position them either in a horizontal position, giving maximum light and visibility therebetween, or a relatively vertical, slightly overlapping position, blocking light and visibility.

For raising and lowering the blind, lift cords 36 are attached to the bottom rail 22 and extend upwardly into the headrail where they are trained over conventional rolls (not shown) and through a conventional cord lock (not shown) to depend adjacent one end of the blind. The lift cords are tied together at their free ends and terminate in a tassel or pull 38. Preferably, a lift cord 36 is provided corresponding to each ladder 25 utilized in the Venetian blind. It will also be appreciated that the tilt wand 32 may be located at one side of the blind and the lift cord tassel 38 at the other, as shown in FIG. 1, or both may be located at one side of the blind.

The Venetian blind slats 24, ladders 25 and lift cords 36 have been shown in the drawings as substantially enlarged in order to clearly demonstrate the present invention. In practice, the slats, while long enough to cover a window or other architectural opening, are of a width giving the desired aesthetic appearance, for example, between about 16 mm and about 50 mm. The riser cords may be of a crocheted or knitted material having a diameter of about 2 mm, while the ladder cross cords or cross rungs may be of similar material and have a diameter of about 0.7 mm, four such strands being preferred. The lift cords are of a twisted woven material and have a diameter of about 1 mm. These materials and dimensions are given for illustrative purposes only, and the Venetian blind components may be selected from a wide variety of materials having varied dimensions.

Figure 5:
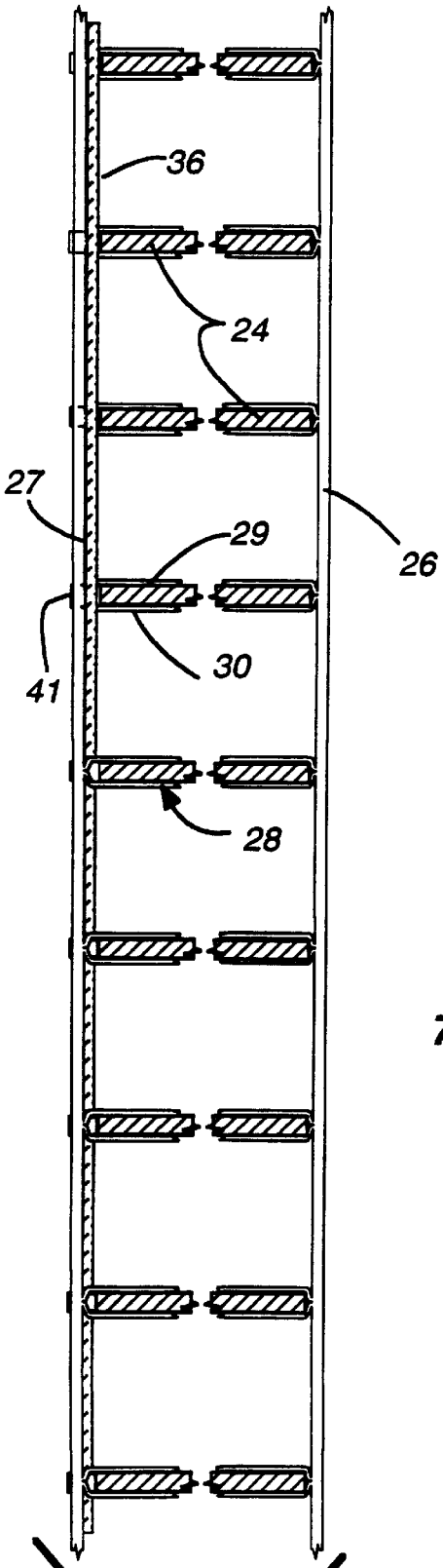
FIG. 5 is an enlarged, generally schematic, cross-sectional view of a modified form of a Venetian blind embodying the present invention.
Figure 7:
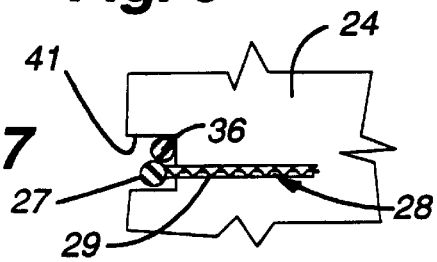
FIG. 7 is a section view taken substantially in the plane of line 7—7 on FIG. 6.

In accordance with the present invention, the lift cords 36 do not extend through slots in the blind slats 24, as in conventional blinds, but rather each lift cord extends along a front side edge 39 or rear side edge 40 of each slat adjacent to a selected front or rear riser cord 26, 27. In order to maintain the lift cords 36 and associated riser cords 26, 27 in close juxtaposition, the lift cords 36 are woven through a ladder 25 across selected cross rungs 28 at spaced intervals of, for example, about five or more cross rungs 28 and along the side edges of the slats 24, as shown in FIGS. 1–4. In other words, the lift cords remain on one side of the rungs while passing beside one group of five or more slats and then extend along the opposite side of the rungs for the next group of five or more slats. The pull or lift cords substantially remain between the front and rear riser cords closely adjacent to one of the riser cords (FIGS. 5–7).

Figures 13A, 13B, 13C, 13D, 13E:
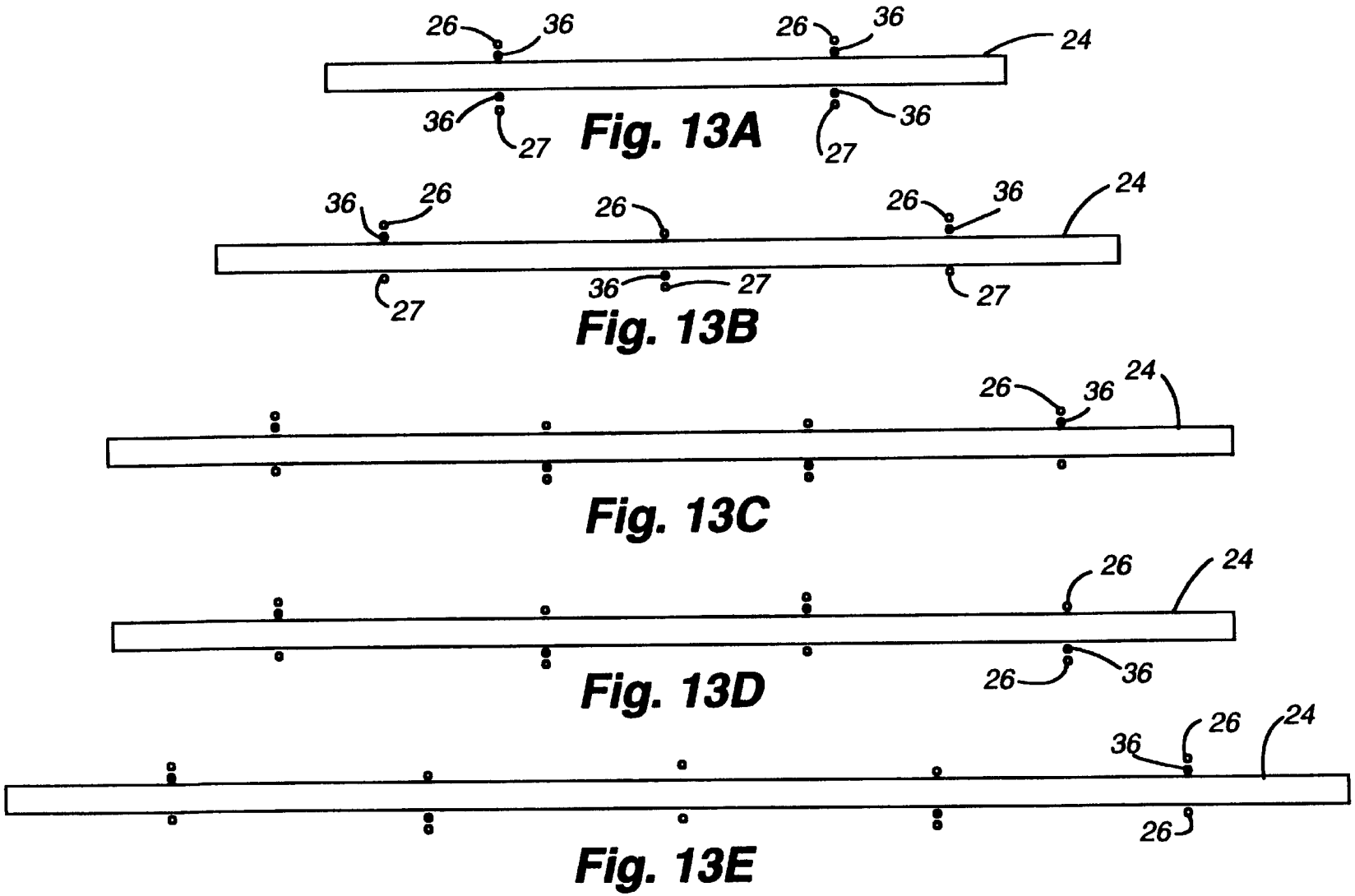
FIG. 13A is a lift cord and riser cord diagram for a two ladder blind.
FIG. 13B is a lift cord and riser cord diagram for a three ladder blind.
FIG. 13C is a lift cord and riser cord diagram for a four ladder blind.
FIG. 13D is a lift cord and riser cord diagram for a modified four ladder blind.
FIG. 13E is a lift cord and riser cord diagram for a five ladder blind.

As an alternative, the lift cords 36, in addition to being woven through the ladder as described above, may also be wound around or intertwined with the adjacent riser cord at spaced intervals along the ladder (FIGS. 8–10), thereby at times passing on the outside of a front or rear riser cord.

Where only two ladders 25 are used, lift cords 36 are used at both the front and rear ladder riser cords 26, 27 at each end of the slats (FIG. 13A). Where three ladders 25 are utilized, the lift cords 36 are positioned adjacent the front ladder riser cord 26 on the ladders 25 at each end of the blind and adjacent the rear ladder riser cord 27 on the intermediate ladder (FIG. 13B). Where four ladders are used (FIG. 13C), the lift cords are positioned adjacent the front ladder cords 26 of the ladders 25 at each end of the slats 24 and adjacent the rear ladder cords 27 at the intermediate ladders, or the lift cords at the intermediate ladders may be on opposite sides of the slats (FIG. 13D). Where more than four ladders 25 are used, the lift cords may alternate between the front and rear edges of the slats 24 (FIG. 13E).

In a modified form of the invention (FIG. 12, FIGS. 5–7, FIGS. 8–10), preferably the rear side edge 40 of each blind slat 24 is formed with a plurality of notches 41 corresponding to each ladder riser cord 27 for receiving the riser cord 27 and, if applicable, the adjacent lift cord 36. The lift cord 36 is preferably positioned generally adjacent or nearest the slat, and the ladder riser cord 27 is positioned outwardly thereof, as shown in FIGS. 5–7. In this construction, the notches help hold the slats 24 in place on the ladders 25.

Figure 8:
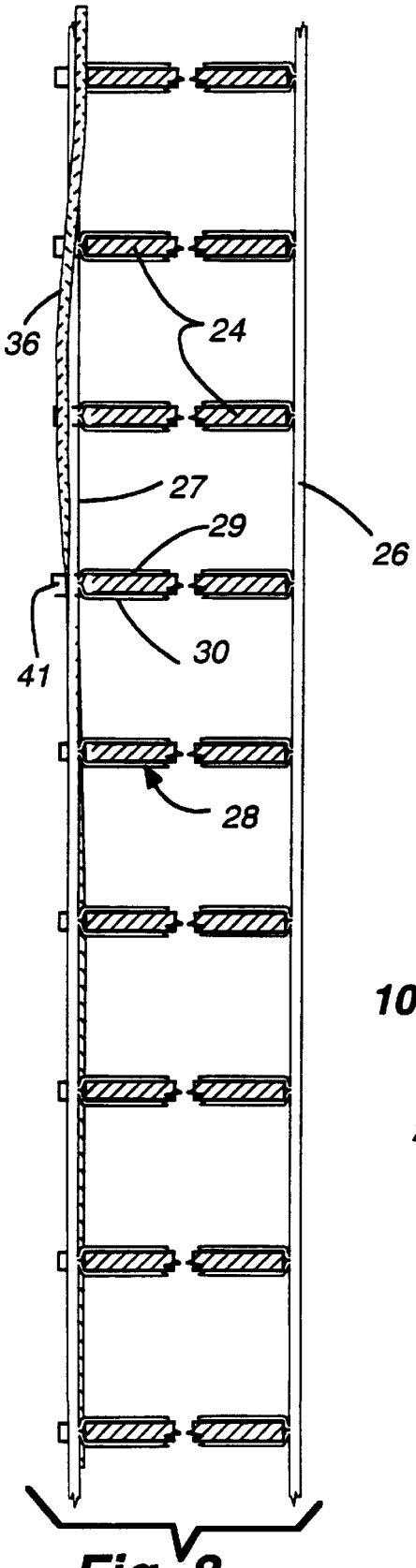
FIG. 8 is an enlarged, generally schematic, cross-sectional view of a further modified form of a Venetian blind embodying the present invention.
Figure 10:
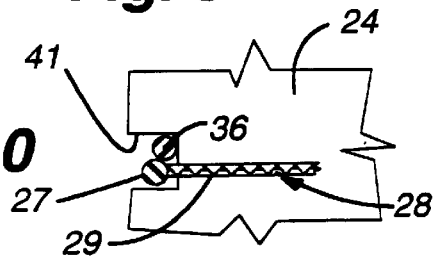
FIG. 10 is a section view taken substantially in the plane of line 10—10 on FIG. 9.

In relationship to the slats 24 and notches 41, the relative positions of the lift cord 36 and the adjacent riser cord 26, 27 will be such that the lift cord 36 is nearest the inner portion of the notch 41, and the ladder riser cord is outwardly thereof, as shown in FIGS. 5–7. The latter also applies when the lift cord is intertwined with the ladder (FIGS. 8–10). Where no notch is provided in the slat 24, which may be preferable for aesthetic reasons, along the front edge of the slats, the ladder riser cord and lift cord will be positioned adjacent the lateral edge of each slat, as shown in FIGS. 1 and 2.

Figure 11:
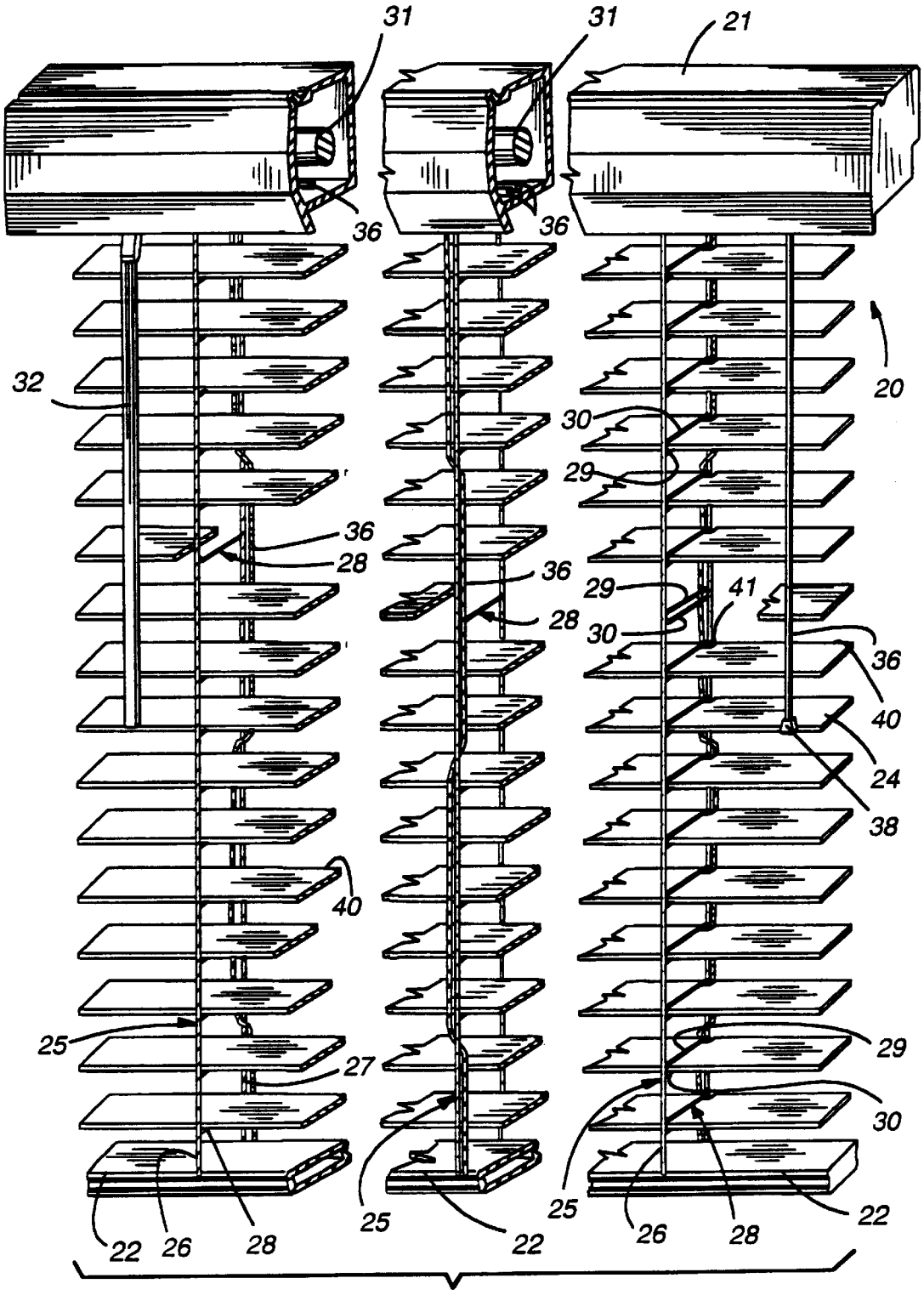
FIG. 11 is an enlarged oblique cabinet view of a further modified form of a Venetian blind embodying the present invention with parts cut away for clarity in illustration.
Figure 12:
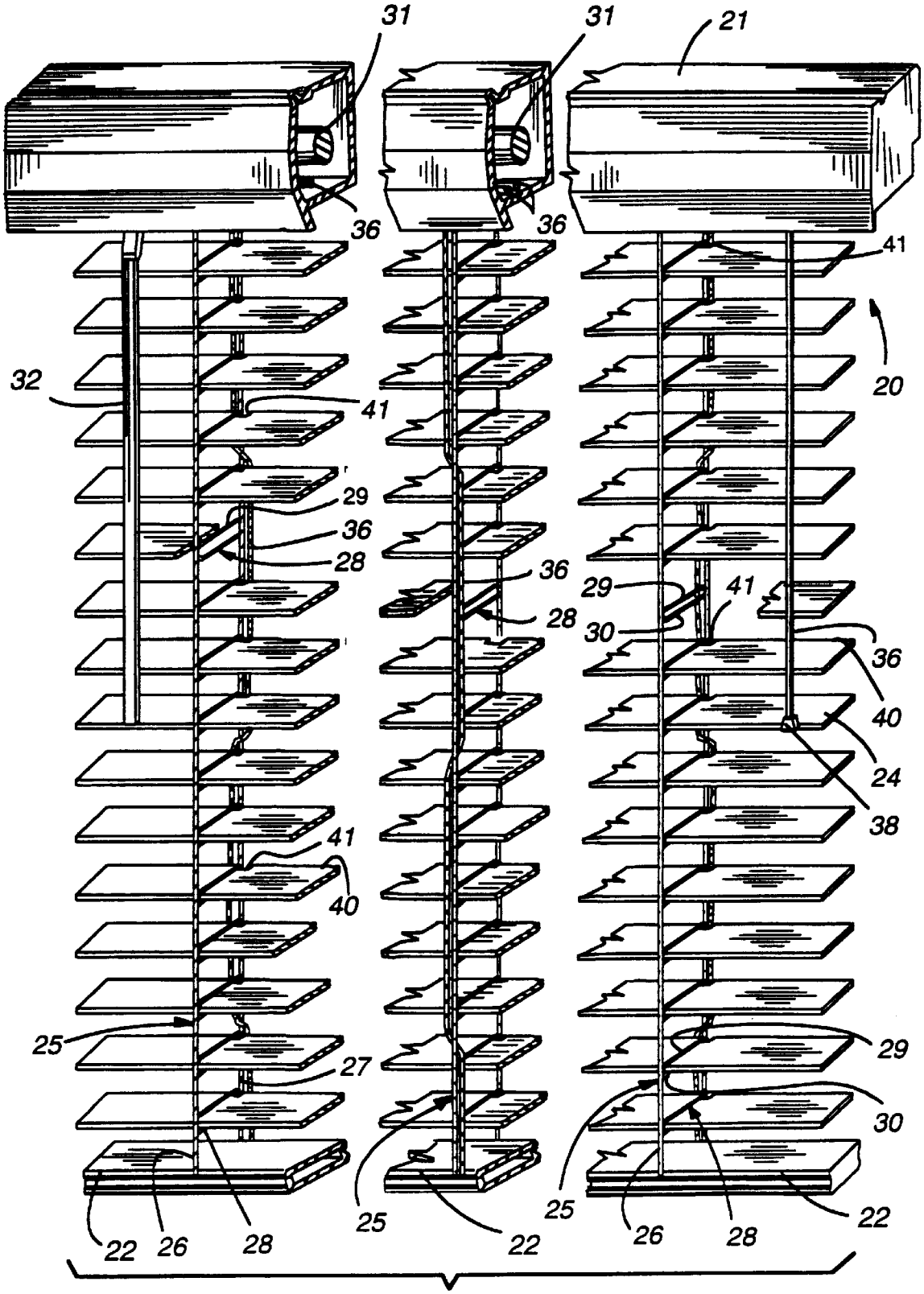
FIG. 12 ia an enlarged oblique cabinet view of a further modified form of a Venetian blind embodying the present invention with parts cut away for clarity.

A further modified form of the present invention utilizes slats 24 with notches only at the control end of the Venetian blind as shown in FIG. 11. The slats may be interlaced as described above.

With the foregoing construction the Venetian blind can be effectively raised or lowered by pulling on or releasing the lift cords 36 and further can be tilted to any desired angle by selectively positioning the ladder riser cords 26, 27 and cross rungs 28.

One of the principal advantages of the present invention is that the need for slots or holes through the Venetian blind slats through which the lift cords pass is eliminated. The blinds can thereby be more easily separated for cleaning or replacement of slats. Further, the elimination of the lift cord slots provides a uniform blind appearance without vertical light lines which can detract from the appearance of the blind. Such blinds further provide for a darker room if less light is desired.

What is claimed is:

1. A Venetian blind comprising a plurality of parallel elongated slats having front and rear longitudinal edges, ladders including a pair of riser cords with one riser cord extending along the front edge of the slats and the other riser cord extending along the rear edge of the slats and spaced apart cross rungs for supporting said slats in vertically spaced apart relation, and lift cords for lifting said slats into closely spaced stacked relation and for lowering said slats into wider spaced relation, at least one of said lift cords being interwoven with the cross rungs of an associated one of said ladders while remaining between the riser cords of the associated ladder substantially along the entire length of said riser cords.

2. A Venetian blind as defined in claim 1 wherein said lift cord is interwoven with said cross rungs in groups of a plurality of cross rungs.

3. A Venetian blind as defined in claim 1 wherein said lift cord is interwoven with said cross rungs in groups of at least two cross rungs.

4. A Venetian blind as defined in claim 1, 2 or 3 wherein selected ones of said slats define notches in the longitudinal edge thereof adjacent at least one said ladder riser cord.

5. A Venetian blind as defined in claim 4 wherein all of said slats define a notch in one longitudinal edge thereof corresponding to at least one of said ladder riser cords.

6. A Venetian blind as defined in claim 4 wherein all of said slats define notches in one longitudinal edge thereof corresponding in location and number to ladder riser cords adjacent said edge.

7. A Venetian blind as defined in claim 4 wherein said edge notches are of a depth and width sufficient to receive said lift cord and said ladder riser cord.

8. A Venetian blind as defined in claim 1 wherein said cross rungs are formed by at least two strands and said slats are inserted between said strands on selected ones of said ladders.

9. The Venetian blind of claim 1 wherein said slats are made of metal.

10. The Venetian blind of claim 1 wherein said slats are made of wood.

11. The Venetian blind of claim 1 wherein said slats are made of plastic.

12. A Venetian blind comprising a plurality of elongated slats having ends and front and rear longitudinal edges, a plurality of ladders, each ladder including a pair of riser cords with one riser cord extending along the front edges of the slats and the other riser cord extending along the rear edge of the slats and spaced apart cross rungs for supporting said slats in vertically spaced apart relation, and lift cords for lifting said slats into closely spaced stacked relation and for lowering said slats into wider spaced relation, said lift cords being intertwined with said riser cords along both the front and rear edges of said slats.

13. The Venetian blind of claim 12 wherein there are at least three of said ladders and with a ladder positioned adjacent to each end of said slats and wherein the lift cord associated with each ladder adjacent the ends of the slats being positioned along the same edge of the slats.

14. The Venetian blind of claim 12 wherein said lift cords are alternately positioned along the front and rear edges of the slats.

15. The Venetian blind of claim 12 wherein said lift cords are also interwoven with said cross rungs.

16. A Venetian blind comprising a plurality of elongated slats having front and rear longitudinal edges, a plurality of ladders, each ladder including a pair of riser cords with one riser cord extending along the front edge of the slats and the other riser cord extending along the rear edge of the slats and spaced apart cross rungs for supporting said slats in vertically spaced apart relation, and lift cords for lifting said slats into closely spaced stacked relation and for lowering said slats into wider spaced relation, said slats further including substantially vertically aligned notches in said rear edge thereof, and wherein said aligned notches have positioned therein a riser cord and a lift cord.

17. The Venetian blind of claim 16 wherein said notches are open along said rear edges of said slats.

* * * * *